US005711453A

United States Patent [19]

Weiler

[11] Patent Number: 5,711,453

[45] Date of Patent: Jan. 27, 1998

[54] CAP WITH DRAINING SPIKE FOR USE WITH HERMETICALLY SEALED DISPENSING CONTAINER

[75] Inventor: Gerhard H. Weiler, South Barrington, Ill.

[73] Assignee: Automatic Liquid Packaging, Inc., Woodstock, Ill.

[21] Appl. No.: 476,090

[22] Filed: Jun. 7, 1995

[51] Int. Cl.[6] ..... B67D 5/00

[52] U.S. Cl. ..... 222/83; 222/541.2

[58] Field of Search ..... 222/83, 91, 206, 222/541.2, 543, 562, 568

[56] References Cited

U.S. PATENT DOCUMENTS

| | | | |
|---|---|---|---|
| 3,454,196 | 7/1969 | Hazard . | |
| 3,580,423 | 5/1971 | Gilman . | |
| 3,783,895 | 1/1974 | Weichselbaum | 222/83 |
| 3,813,009 | 5/1974 | Lenz . | |
| 4,624,393 | 11/1986 | Lopez . | |
| 4,681,243 | 7/1987 | Takasugi | 222/541.2 |
| 4,706,827 | 11/1987 | Cabernoch et al. | 222/83 |
| 4,723,687 | 2/1988 | Kutterer . | |
| 4,898,293 | 2/1990 | Morel | 222/83 |
| 5,228,592 | 7/1993 | Pellerano . | |
| 5,427,275 | 6/1995 | Hansen | 222/83 |

*Primary Examiner*—Philippe Derakshani
*Attorney, Agent, or Firm*—Olson & Hierl, Ltd.

[57] ABSTRACT

A cap equipped with a dispensing nozzle is provided for use with a hermetically sealed container which includes a neck portion sealed by a pierceable membrane. A spike within the cap pierces the membrane when the cap is threaded onto the neck portion of the container so as to provide access to the contents of the container. The spike includes a passageway in fluid flow communication with a dispensing nozzle on the cap so as to allow dispensing of the contents of such container.

10 Claims, 2 Drawing Sheets

FIG. 1
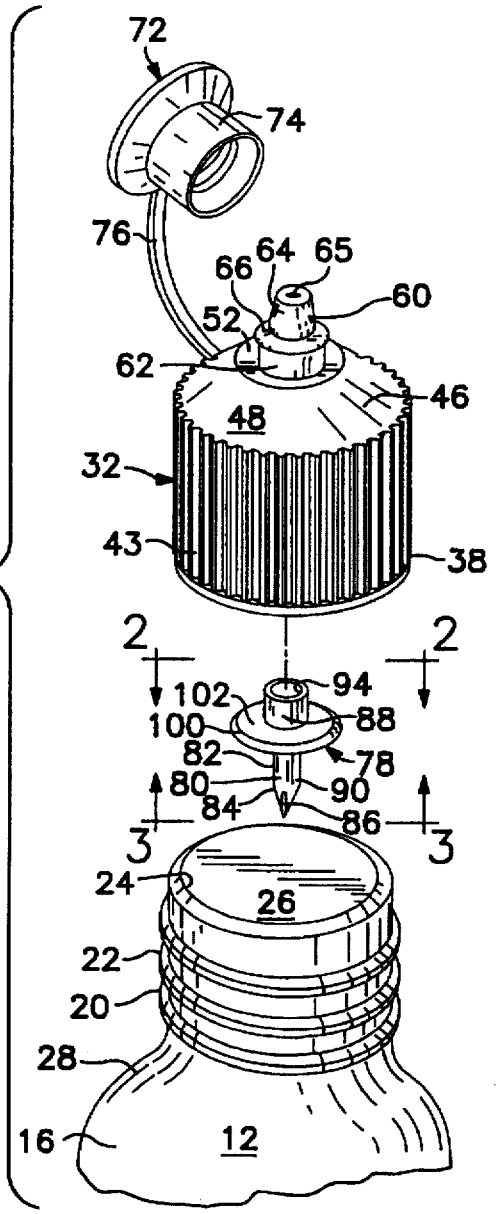
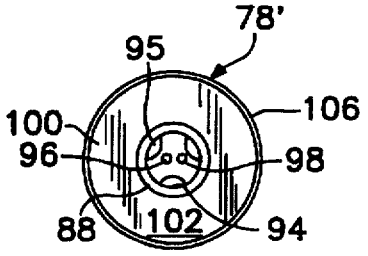
FIG. 2
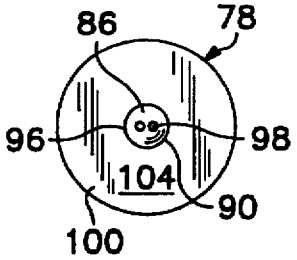
FIG. 3

CAP WITH DRAINING SPIKE FOR USE WITH HERMETICALLY SEALED DISPENSING CONTAINER

TECHNICAL FIELD OF THE INVENTION

This invention relates to a hermetically sealed dispensing container having a unitary sealing membrane and, more particularly, to a dispensing cap therefor having a draining spike therein which pierces the container membrane as the cap is secured to the container so as to provide access to the container contents.

BACKGROUND OF THE INVENTION

Packaging systems that form, fill, and seal containers such as thermoplastic bottles enjoy widespread commercial acceptance through ease of operation and reduced labor costs. A container or bottle of this type is formed of thermoplastic material, filled with the desired substance, and then sealed in one continuous operation as disclosed in U.S. Pat. No. 4,178,976 to Weiler et al. Generally, the container is sealed by a pierceable membrane which is unitary with an opening defined by the throat or neck portion of such container. Such a packaging system obviates the need for costly auxiliary equipment to clean and handle empty containers, fill the containers, and seal the containers. The system is particularly desirable where a sterilized fluid is to be sealed within a container and thereafter maintained in a sterile condition.

However, some means must be provided to pierce the membrane and obtain access to the contents within the container. Access to the contents is presently accomplished by first piercing the membrane with a suitable instrument such as a knife or the like so as to provide access to the container contents and then securing a cap with a dispensing nozzle over the neck portion to allow dispensing of the container contents. This means, however, is undesirable in medical applications and, particularly, in emergency medical applications where time is of the essence since the present means is a two-step process. Moreover, this means is undesirable because the membrane may often times be pierced with a non-sterile instrument thus increasing the likelihood that the sterile contents of such container may be contaminated.

It would be desirable if the membrane could be pierced with a sterile instrument simultaneously with the securement of the cap to the container. The present invention meets these desires.

SUMMARY OF THE INVENTION

The present invention contemplates a new and useful dispensing cap for use in connection with a hermetically sealed thermoplastic container including a hollow body portion which terminates into a threaded neck portion defining an opening sealed with a membrane unitary therewith. The cap is threadedly secured over the neck portion of the container and is provided with a dispensing nozzle. A draining spike of relatively harder material than the cap is located within the cap and is adapted for piercing the membrane when the cap is secured to the neck portion so as to provide access to the interior of the body portion. The draining spike is in fluid flow communication with the dispensing nozzle so as to allow the dispensing of the container contents.

Preferably, the cap includes a dome portion from which the dispensing nozzle outwardly extends. The dome portion defines an inner recess and the dispensing nozzle includes an inner channel.

The draining spike comprises an elongated member including a generally cylindrical body portion, a conical pointed tip or piercing portion which extends away from the body portion and a peripheral flange. The cylindrical body portion and peripheral flange are nested within the channel and recess respectively thereby securing the spike within the cap.

Because the spike is nested within the cap, the membrane can be pierced at the same time that the cap is being secured to the container thus eliminating the step of piercing the membrane prior to securement of the cap to the container. Moreover, the use of a spike within the cap allows the membrane to be pierced with a sterile instrument thus assuring the continued sterility of the container contents.

There are other advantages and features of the present invention which will be more readily apparent from the following detailed description of the preferred embodiment of the invention, the drawings, and the appended claims.

BRIEF DESCRIPTION OF THE DRAWINGS

In the drawings,

FIG. 1 is an exploded fragmentary perspective view of a dispenser embodying this invention and showing a hermetically sealed container in association with a cap and a draining spike adapted to fit within the cap;

FIG. 2 is an enlarged top plan view of the draining spike taken generally along the plane 2—2 of FIG. 1;

FIG. 3 is an enlarged bottom plan view of the draining spike taken generally along the plane 3—3 of FIG. 1.

DESCRIPTION OF THE PREFERRED EMBODIMENT

Figure 4:
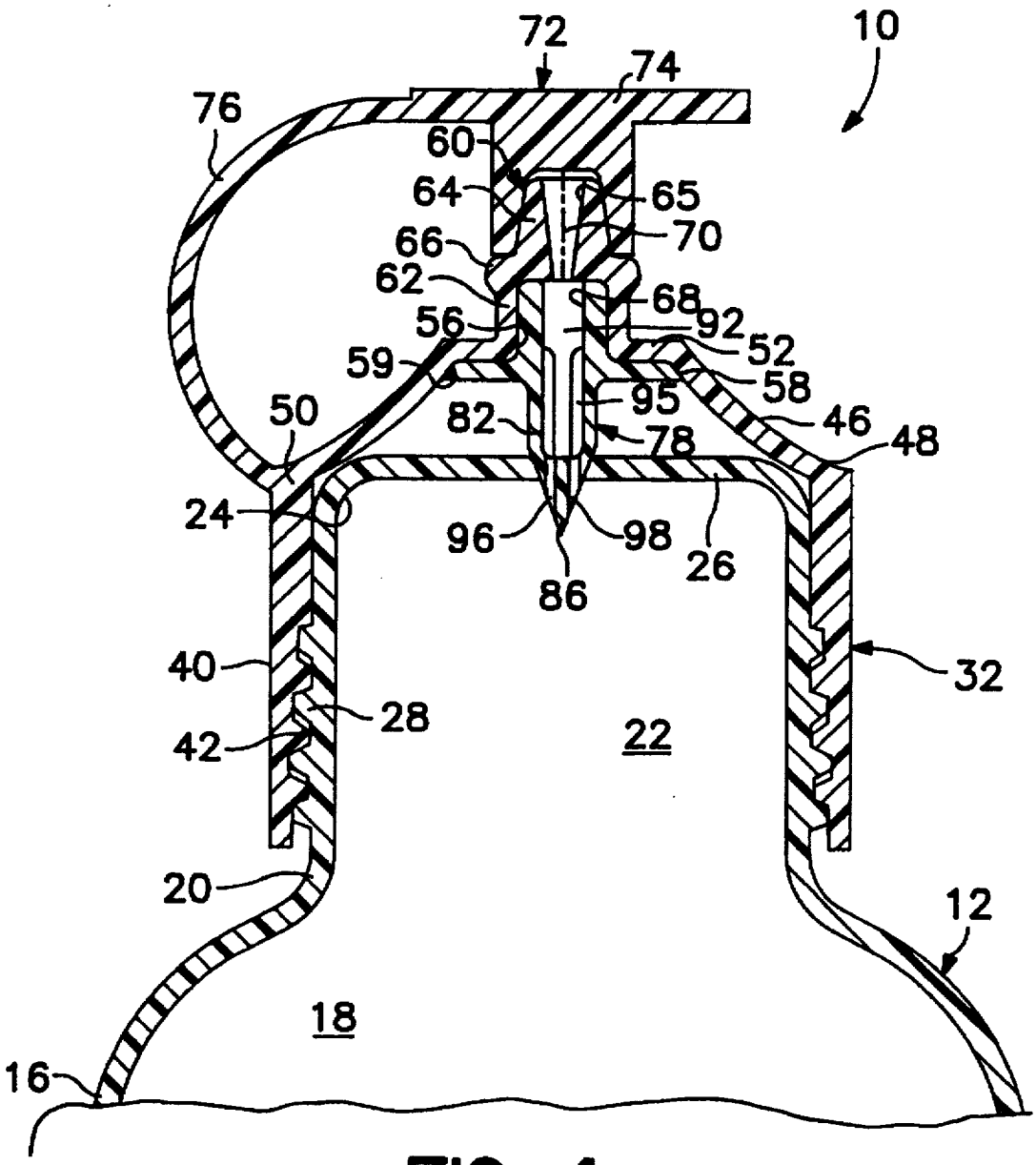
FIG. 4 is an enlarged fragmentary cross-sectional view of the dispenser showing the cap threaded and secured to the neck portion of the container and the spike therein piercing the container membrane.

The invention disclosed herein is, of course, susceptible of embodiment in many different forms. Shown in the drawings and described hereinbelow in detail is a preferred embodiment of the invention. It is to be understood,. however, that the present disclosure is an exemplication of the principles of the invention and does not limit the invention to the illustrated embodiment.

For ease of description, a dispenser constituted by a container equipped with the cap embodying the present invention is described hereinbelow in its usual assembled position as shown in the accompanying drawings and terms such as upper, lower, horizontal, etc., will be used herein with reference to this usual position. However, the container and cap may be manufactured, stored transported, sold, or used in orientations other than that described and shown herein.

Referring now to FIGS. 1 and 4, dispenser 10 embodying this invention comprises a hermetically sealed container 12 and a cap 32 associated therewith. Container 12 is of unitary construction and includes a hollow body portion 16 whose walls are relatively thin and which define a liquid-holding cavity 18. Body portion 16 and cavity 18 can have any convenient or desired configuration. The container configuration shown, however, is presently preferred, particularly with the body portion 16 sized to fit into the palm of the average or typical adult human hand. The walls of body portion 16 are relatively thin so that body portion 16 can be manually squeezed, i.e., compressed or distorted to dispense a liquid fill therefrom.

Container 12 can be molded using a thermoplastic polymer. Presently preferred polymers are low density polyethylene (LDP), high density polyethylene (HDPE), polypropylene (PP), and the like. The thickness of body portion 16 can vary from one location to another, but is preferably formed as thin as practical, consistent with structural strength requirements.

Container 12 can be made by a parison molding procedure wherein body portion 16 is formed first, then filled with a desired liquid fill, and thereafter sealed with a pierceable membrane. The form, filling and sealing operations are carried out automatically under sterile conditions using procedures known to the art as disclosed in the aforementioned U.S. Pat. No. 4,178,976 to Weiler et al.

The cap 32 of the present invention can be fabricated with automatic molding apparatus and other mechanisms, the details of which, although not fully illustrated or described, will be apparent to those having skill in the art and an understanding of the necessary functions of such apparatus and mechanisms. The detailed descriptions of such apparatus and mechanisms are not necessary to an understanding of the invention and are not herein presented because such apparatus and mechanisms form no part of the present invention.

Referring back to FIGS. 1 and 4, one end 20 of body portion 16 terminates in a tapered neck or throat portion 22 which is unitary with body portion 16. The neck portion 22 defines an opening 24 sealed with a pierceable membrane 26 unitary therewith. The neck portion 22 and body portion 16 are usually positioned substantially symmetrically about a common longitudinal axis.

External screw threads 28 are formed about the periphery of neck portion 22. The threads 28 extend circumferentially outwardly about an outside wall region of neck portion 22. Screw threads 28 can be left-handed or right-handed, as desired.

The cap 32 includes a skirt portion 38 defined by a generally cylindrical peripheral wall 40. The wall 40 is provided with internal screw threads 42 about an inside surface region thereof. The cap screw threads 42 are threadingly engageable with the neck portion screw threads 28. In the embodiment illustrated, the exterior surface of the wall 40 is generally cylindrical, but it also has a plurality of vertically aligned grooves 43 to facilitate gripping of the cap 32. Other gripping means are suitable as well.

The cap 32 also includes a unitary dome portion 46 comprising a frustoconical wall 48 which projects unitarily upwardly from a distal terminus 50 of the skirt portion 38. The dome portion 46 also includes a circular cross wall 52 which projects unitarily horizontally from a distal terminus of frustoconical wall 48. The cross wall 52 includes a centrally disposed circular aperture or opening 56 and a cylindrical recess 58 concentric with the aperture 56. The recess 58 includes a tapered lateral peripheral surface 59.

Moreover, the cap 32 includes a dispensing nozzle 60 including a generally cylindrical portion 62 which projects unitarily longitudinally upwardly from the aperture 56 in cross wall 52 and a frustoconical portion 64 which projects unitarily convergently upwardly from the cylindrical portion 62 and which terminates into a dispensing orifice 65. An annular shoulder 66 is defined in the region between cylindrical portion 62 and frustoconical portion 64. A generally cylindrical channel 68 extends centrally axially from the aperture 56 through the cylindrical portion 62 of nozzle 60 and an upwardly divergingly tapered frustoconical channel 70 extends centrally axially through the frustoconical portion 64 between the channel 68 and orifice 65. The channels 68 and 70 are in fluid flow communication with each other.

The cap 32 can be made of a plastic material such as polypropylene, polyethylene, or the like and also includes a removable closure 72 including a closure member 74 adapted to be secured over the nozzle 60 and a flexible arm 76 extending between the closure member 74 and terminus 50 of skirt portion 38.

A draining spike 78 is made of relatively harder material than the cap and is located within the cap 32 for piercing the membrane 26 when the cap 32 is threadingly secured to the neck portion 22. This provides access to the liquid within body portion 16 of container 12. Spike 78 comprises an elongated member 80 including a generally cylindrical body portion 82 which terminates at a distal end 84 thereof into a pointed conical tip or piercing portion 86. The cylindrical body portion 82 is comprised of a first generally cylindrical segment 88 and a second generally cylindrical segment 90 unitary and integral with the first segment 88 but having a diameter less than the diameter of first segment 88. The body portion 82 includes a bore 92 which extends centrally axially therethrough and terminates into an aperture 94 at the end of the first segment 88. A plurality of fins 95 extend longitudinally around the circumference of the bore 92. The tip portion 86 includes diametrically opposed inner passages 96 and 98 which extend longitudinally between the outer surface of piercing portion 86 and the bore 92. The bore 92, in fluid flow communication with the passages 96 and 98, defines a draining passageway. The draining spike can be made of styrene, acrylonitrile-butadiene-styrene (ABS), and the like.

Referring to FIGS. 2 and 3, the spike 78 also includes a flange 100 extending outwardly around the periphery of body portion 82 in the region between the first and second segments 88 and 90 respectively. The flange 100 includes an upper surface 102 and a lower surface 104 interconnected by a tapered lateral face 106.

According to the invention, the spike 78 is secured within the cap 32 and, more particularly, depends inwardly from the dome portion 46 thereof such that the first segment 88 of body portion 80 is nested within the channel 68 of nozzle 60 and the flange 100 is nested within the recess 58 in cross wall 52 and the second segment 90 and piercing portion 86 extend inwardly into the interior of cap 32. In the nested position, the tapered lateral surface of recess 58 engages the lateral tapered face 106 of flange 100 so as to provide a press fit of the spike 78 within cap 32. Moreover, in the nested position, the bore 92 of spike 78 is in fluid flow communication with the channel 68 in nozzle 60.

According to the invention, liquid is dispensed from the container 12 as described below initially, cap 32 is positioned over the neck portion 22 so as to begin threadable engagement between respective screw threads 28 and 42. The cap 32 is then rotated, relative to the neck portion 22 in a direction which increases the amount of such threadable engagement and causes the spike 78 to move towards the membrane 26, until the cap 32 is fully threaded onto the neck portion 22 and the piercing portion 86 of spike 78 has penetrated the membrane 26 as shown in FIG. 4 thus providing an access to the liquid in the body portion 16 of container 12.

Then, upon squeezing and/or tilting of the container 12, the liquid in body portion 16 may be dispensed through the nozzle 60 via passages 96 and 98 and bore 92 in spike 78 and channels 68 and 70 and dispensing orifice 65 in nozzle 60.

I claim:

1. A dispenser comprising:

a hermetically sealed container including a hollow body portion terminating into a threaded neck portion defining an opening sealed with a membrane unitary therewith;

a cap threadedly secured over the neck portion and provided with a dispensing nozzle; and a draining spike within the cap for piercing the membrane when the cap is secured over the neck portion so as to provide access to the interior of the body portion and in fluid flow communication with said dispensing nozzle;

said cap including a dome portion from which said dispensing nozzle extends outwardly, said dome portion defining an inner recess and said dispensing nozzle including an inner channel, said spike comprising an elongated member including a generally cylindrical body portion and a peripheral flange, said cylindrical body portion and said peripheral flange being nested within said channel and said recess respectively; and said peripheral flange including a tapered lateral face and said recess including a tapered lateral surface engaging said lateral face.

2. The dispenser of claim 1 wherein the spike comprises an elongated member including a generally cylindrical body portion and a pointed tip portion extending away from the body portion.

3. The dispenser of claim 1 wherein a plurality of peripherally spaced fins extend into a draining passageway defined by the draining spike.

4. A cap suitable for providing access to a hermetically sealed container having an externally threaded throat member sealed by a pierceable membrane, the cap comprising:

a dome portion provided with an outwardly extending dispensing nozzle and a removable closure for the nozzle;

a skirt portion unitary with the dome portion and provided with internal threads for engagement with said externally threaded throat member; and a draining spike depending inwardly from said dome portion and defining a draining passageway in fluid flow communication with said dispensing nozzle;

wherein said dome portion defines an inner recess and said draining spike is provided with a peripheral flange, said peripheral flange being nested within said recess, and wherein said peripheral flange includes a tapered lateral face and said recess includes a tapered lateral surface engaging said lateral face.

5. The cap of claim 4 wherein the draining spike comprises an elongated body member including a generally cylindrical body portion that terminates at the distal end thereof into a piercing portion, the piercing portion penetrating the membrane when the cap is threaded onto said throat member.

6. The cap of claim 5 wherein the dispensing nozzle includes an inner channel within which the cylindrical body portion of said spike is nested.

7. The cap of claim 4 wherein the dome portion defines an inner recess, and said dispensing nozzle includes an inner channel, said spike comprising an elongated member including a generally cylindrical body portion and a peripheral flange, said cylindrical body portion and said peripheral flange being nested within said channel and said recess respectively.

8. The cap of claim 4 wherein a plurality of peripherally spaced fins extend into a draining passageway defined by the draining spike.

9. A cap suitable for providing access to a hermetically sealed container having an externally threaded throat member sealed by a pierceable membrane, the cap comprising:

a dome portion provided with a dispensing nozzle extending outwardly from the dome portion and a removable closure for the nozzle, the nozzle defining an inner passageway and an inner recess with a tapered lateral surface surrounding the passageway at the proximal end of the nozzle;

a skirt portion unitary with the dome portion and provided with internal threads for engagement with said externally threaded throat member; and a draining spike comprising an elongated member having a generally cylindrical body portion that terminates at the distal end thereof into a piercing tip and a peripheral flange that includes a tapered lateral face, said spike depending inwardly from said dome portion such that said cylindrical body portion and said peripheral flange are nested within the inner channel and recess respectively, and the tapered lateral face engages said tapered lateral surface, said piercing tip penetrating the membrane when the cap is threaded onto said throat member, said cylindrical body portion and said piercing tip together defining a draining passageway in fluid flow communication with said inner channel of said dispensing nozzle.

10. The cap of claim 9 wherein a plurality of peripherally spaced fins extend into the draining passageway defined by said cylindrical body portion of said spike.

* * * * *